US006457907B1

(12) United States Patent
De Bloeme

(10) Patent No.: US 6,457,907 B1
(45) Date of Patent: Oct. 1, 2002

(54) METHOD AND DEVICE FOR CARRYING OUT WORK ON AN OBJECT WHICH IS PRESENT UNDER WATER

(76) Inventor: Hendrik De Bloeme, Karweistraat 10, NL-3264 XV Nieuw Beijerland (NL)

( * ) Notice: Subject to any disclaimer, the term of this patent is extended or adjusted under 35 U.S.C. 154(b) by 0 days.

(21) Appl. No.: 09/701,092

(22) PCT Filed: May 21, 1999

(86) PCT No.: PCT/NL99/00320

§ 371 (c)(1),
(2), (4) Date: Apr. 13, 2001

(87) PCT Pub. No.: WO99/61310

PCT Pub. Date: Dec. 2, 1999

(30) Foreign Application Priority Data

May 22, 1998 (NL) ..... 1009246

(51) Int. Cl.[7] ..... B63C 11/00

(52) U.S. Cl. ..... 405/185; 405/188; 405/192; 114/314

(58) Field of Search ..... 405/8, 11, 12, 405/13, 185, 188, 189, 192, 193, 194, 195.1, 203, 204, 205; 114/314

(56) References Cited

U.S. PATENT DOCUMENTS

| | | | |
|---|---|---|---|
| 3,706,206 A | 12/1972 | Clark | 61/69 R |
| 3,851,487 A | 12/1974 | Lambertsen | 61/69 R |
| 3,879,953 A | 4/1975 | Clark | 61/63 |
| 4,047,390 A | 9/1977 | Boyce, II | 61/69 R |

*Primary Examiner*—Heather Shackelford
*Assistant Examiner*—Frederick L. Lagman

(57) ABSTRACT

A method for carrying out work on an object which is present under water, in particular, a shipwreck, wherein persons make their way to the object under water and carry out the work in artificial light. A cover is provided over the object, which cover in the main abuts the bottom on which or in which the object is present in surrounding relationship with respect to the object. The cover encloses a space in which persons can work and it comprises an entrance for admitting persons to the space.

40 Claims, 6 Drawing Sheets

METHOD AND DEVICE FOR CARRYING OUT WORK ON AN OBJECT WHICH IS PRESENT UNDER WATER

The invention relates to a method and a device for carrying out work or an object which is present under water, wherein persons make their way to said object under water and carry out said work in artificial light. Such a method can be used in particular when carrying out work on a shipwreck, but the method can also be used for carrying out other kinds of work under water, for example in a river or on the seabed. In this connection, the removal of undesirable objects, such as poison gas grenades present in the seabed may be considered.

When work is being carried out under water, visibility is often limited because the water contains solid particles, which are carried along by currents in the water. Another problem that occurs when carrying out work under water is the fact that there is often a current in the water. Thus, there is a continuous current in rivers, and work on the seabed is often impeded by a changing current caused by the tides.

When there is a current in the water, limited visibility ensues, tools and other objects may be carried along by the current, holes that have been dug in the bottom may fill up and, especially when the current is a changing current, the people who carry out the work may become disoriented. In the case of tidal currents, it is often possible to carry out work under water only during the short period of time during which there is no current.

The object of the invention is to provide a method and a device which make it possible to carry out work under water in an efficient manner.

In order to accomplish that objective, a cover is provided over the object, which cover in the main abuts the bottom on which or in which the object is present in surrounding relationship with respect to said object, which cover encloses a space in which persons can work and within which artificial lighting is provided, which cover comprises an entrance for admitting persons to said space. Thus, a space is provided round the object in which there is no current and in which an optimum environment can be created for carrying out work.

Preferably, clean water is supplied to said space, which can take place near the highest point of said space, which water is preferably filtrated. To that end, filters may be provided on the upper side of the cover, through which filters the water is passed. Outside the cover, the water is clearer near the upper side of the cover than near the bottom, so that this is a suitable place for drawing in water from the surrounding space.

In another preferred embodiment, water is supplied to said space by utilizing the flow of the water surrounding the cover. One side wall is thereby provided with a water inlet, whilst one side on the other side of the cover is provided with a water inlet. Only cleaned water can flow into the space through a filter mounted in said inlet. When there are changing currents, it is possible to use several inlets and outlets, which can alternately be opened and closed.

In one preferred embodiment, means are present for draining water from the space. Said means preferably comprise drain openings in the side wall of the cover, namely at a height of less than half, preferably less than one-quarter, more preferably less than one-eighth, of the height of the space under the cover. As a result, the water in the lower part of the space, which the level of pollution is usually highest, will be drained off, whilst clean water can be supplied on the upper side of the cover.

Preferably, the device is provided with a fixedly disposed pump, which is connected, via a flexible conduit, to a nozzle by means of which substance can be sucked from the space. In this manner the persons carrying out work can remove polluted water or sand at random places.

Preferably, a number of connecting points are present on the inside of the cover for connecting the flexible conduit thereto, in which connecting points said flexible conduit can be connected to the fixedly disposed pump.

Preferably, the cover is provided with a downwardly extending wall at its circumferential edge, which wall can be pressed into the bottom. When a layer of sand is present on the bottom, this is a very efficient manner of effecting a proper connection to the bottom.

Preferably, the cover is provided with suction anchors, by means of which the cover is pressed against the bottom. Such suction anchors are known per se and they are capable of pressing the edge of the cover against or into the bottom.

It is also possible to press the cover against the bottom by reducing the pressure under said cover in comparison with the pressure outside the cover. Naturally, this is only possible when the edge of the cover in the main abuts the bottom and when direct and indirect connections between the interior and the exterior of the cover, inter alia connections which take place via filters, are closed. When the pressure is reduced in this manner, the edge of the cover can be pressed down to extend into the bottom.

Preferably, a piece of a flexible material is secured to the edge of the cover which extends to a point near the bottom, which material can be provided between said edge and the bottom. The flexible material may comprise one or more compartments, which can be filled with a material having a higher specific mass than water, for example sand and/or gravel. In this manner it is possible to obtain a good connection to the bottom, in particular when the bottom is not flat and consists of stones, for example.

Preferably, means are present for limiting the pressure difference between the space under the cover and the surrounding space. Such a safety valve is capable of limiting the pressure difference in two directions, for example at a level of less than one per cent.

By keeping the pressure in said space slightly higher than that in the surrounding space, it is possible to prevent an undesirably large amount of water flowing into said space from the surrounding space, for example when opening a lock.

Preferably, a living space is present under or near said cover, which space is capable of accommodating persons. Air can be supplied to said living space, and the living space may be heated, whereby persons who carry out work can stay in said space from time to time. This is important in particular if work is being carried out at great depth, so that persons must follow a lengthy procedure in order to get to the water surface. In that case, they may even carry out work for several days on end without having to make their way to the water surface from time to time.

Preferably, the cover can be moved in floating position, wherein floating bodies are present near the circumferential edge (seen in plan view), which floating bodies are filled with air. It is possible thereby to move the cover even in very shallow water. In order to ensure that the cover will remain stable while being moved, the cover can be turned upside-down, that's, floating in upside-down position, in which position the cover can be towed by a tugboat.

Preferably, the cover is moved up from the bottom by filling compartments which are present near the centrally positioned upper part of the cover with air. Said compartments are provided with pressure relief valves in order to allow air to escape from the compartments while the cover is rising, so that the air pressure in the compartments can decrease. This makes it possible for the cover to rise in the water in a stable position.

Preferably, an engine room is present in or near the cover, in which air can be compressed and/or electricity can be generated. It is also possible, however, to carry out such operations in a module which floats on the water surface, which module is connected to said space by means of the necessary hoses and conducting wires.

In order to obtain proper lighting of the space, lighting equipment is provided in the side walls of the cover, which lighting equipment consists of lamps which are mounted at a height of less than three-quarters, preferably less than half, of the height of said space. Since the persons who carry out the work are often positioned above the place where they are carrying out said work, illumination from the side is advantageous.

The outside of the cover, seen in sectional view of the cover, is preferably semi-circular, ellipsoid or oval, or shaped otherwise with a view to minimizing the flow resistance of the cover.

Further aspects of the invention and of the method, which can be used separately as well as in combination with each other, will be described by means of an embodiment and be defined in the claims.

Preferably, the inner side of the cover is provided, at least locally so, with light-reflecting means. This will enhance visibility within the cover. Said reflection can also be achieved by lining the cover with a lightly coloured, preferably practically white, material.

In order to explain the invention more fully, an embodiment of a cover will now be described with respect to the drawing.

The figures are merely schematic representations, wherein parts corresponding to each other are indicated by the same numerals.

Figure 1:
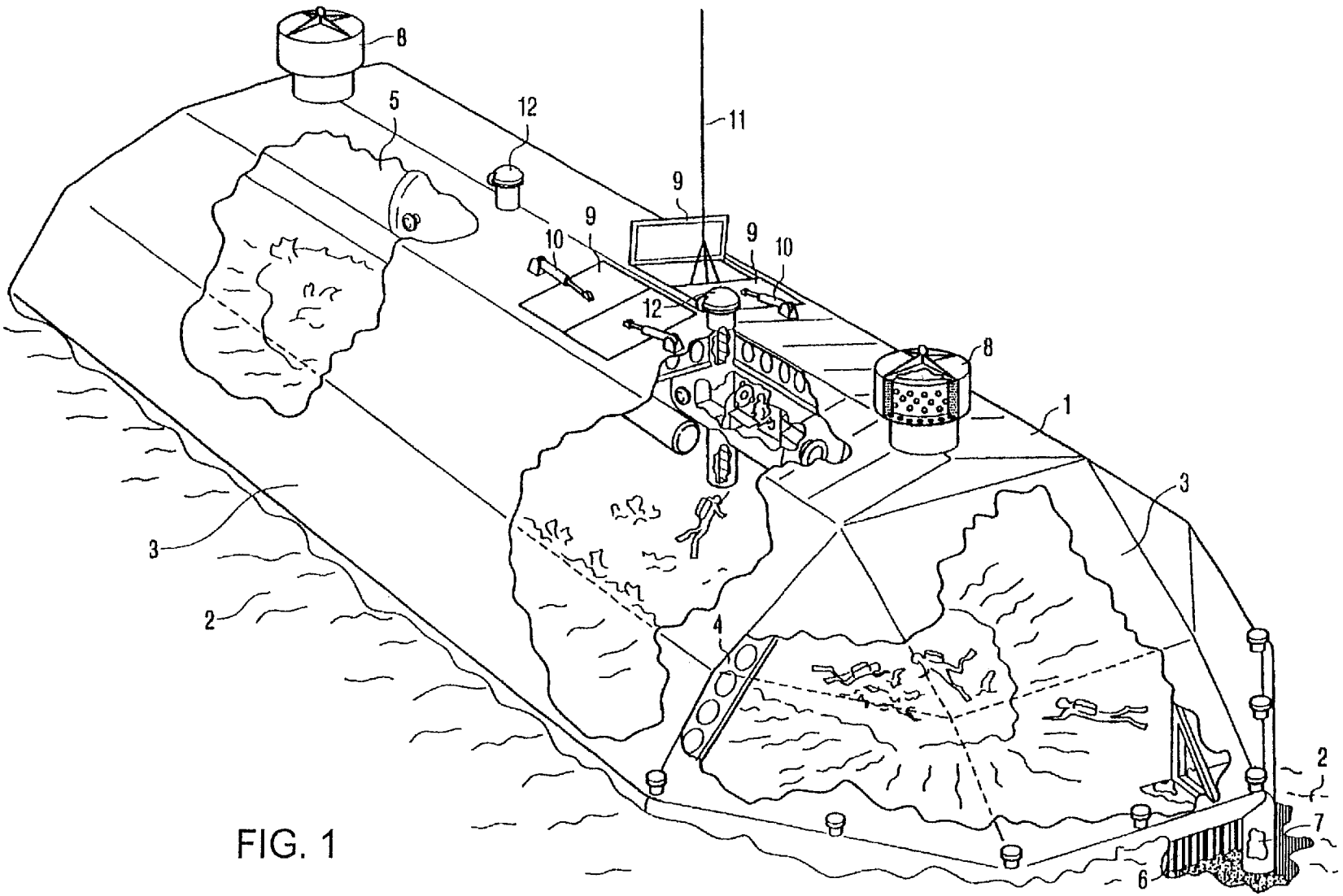
FIG. 1 shows a cover disposed on the seabed.

FIG. 1 shows a cover 1, which is secured to a bottom 2 under water. The cover comprises a wall 3 of sheet steel, which is shown in cut-away view in three places in FIG. 1. The sheets of wall 3 are mounted on girders 4, thus providing a solid structure having a length of 80 meters, a width of 30 meters and a height of 10 meters, for example. The sheet steel has a thickness of 4–8 mm, for example. A space 5 has been created under cover 1, in which space water is present, within which water is present whose pressure substantially corresponds to that of the water outside cover 1, which water in space 5 is separated from its surroundings, however, thus making it possible to condition said water.

The cover according to the embodiment as shown in FIG. 1 is provided along its bottom edge with a downwardly extending wall 6, which has been inserted into bottom 2 by means of a number of suction anchors 7. Suction anchors, which are capable of sinking into a bottom and thus developing a large downward force, are known per se.

Cover 1 forms an enclosure which can be positioned on the bottom of the sea or of a river, and within which the water can be conditioned, for example to enable examination of a shipwreck. On its upper side, cover 1 is provided with two filter devices 8, by means of which water from the surrounding space can be filtered in order to be introduced into the space within cover 1 without any Pollution being present therein. The filters may also be fitted in such a manner that they do not extend outside the cover, and they may be closable so as to block the through-flow of water.

The cover is furthermore provided with hatches 9, which can be opened and closed by means of hydraulic cylinders 10. This makes it possible to move goods to and from space 5 by means of a hoisting cable 11 which is lowered into the water.

The cover is furthermore provided with locks 12, through which persons and/or goods can pass in order to enter space 5 or leave said space 5.

Figure 2:
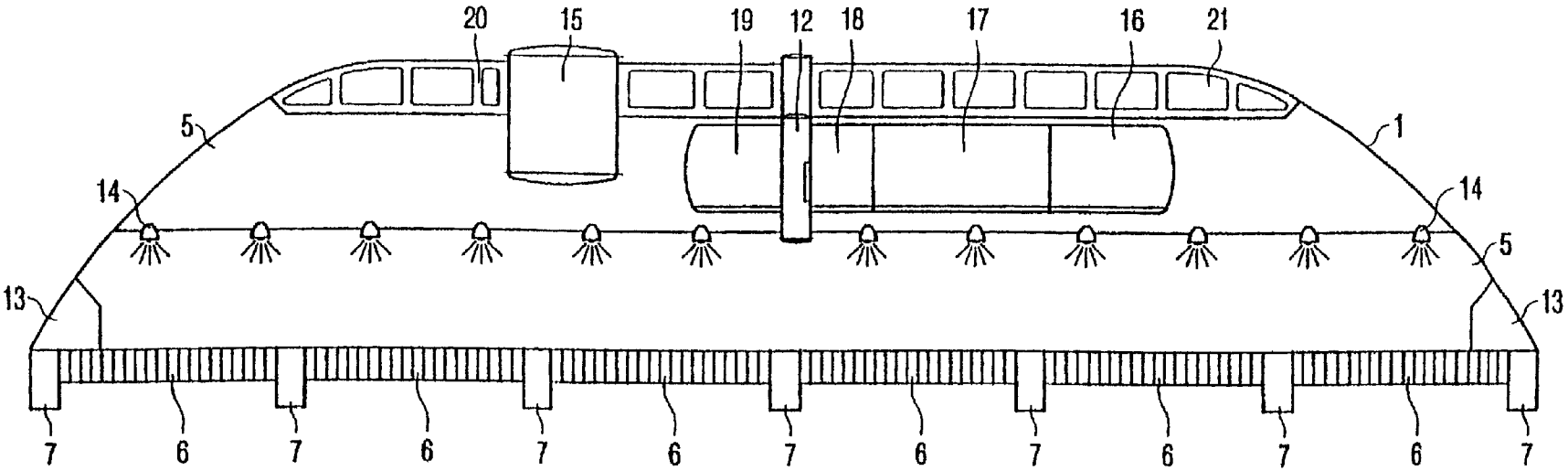
FIG. 2 is a longitudinal sectional view of cover.

FIG. 2 is a longitudinal sectional view which shows a number of the aforesaid parts, such as the walls 6 inserted into the bottom and the suction anchors 7. A floating body 13 surrounds the cover near the lower edge thereof. In order to make the cover float, said floating body 13, which may be subdivided into compartments, can be entirely or partially filled with air.

A number of lamps 14 are mounted along the side wall of cover 1 for lighting the space 5. Said lamps can be aimed in the desired direction, so that certain parts of space 5 can be optimally lighted as desired.

In FIG. 2, a large lock 15, which is dimensioned to admit large objects, is positioned beside lock 12, which functions to admit persons. Said lock 15 is provided with a closable opening at both ends, which opening can alternately be opened and closed.

Lock 12 forms the entrance to a living space consisting of sleeping space 16, a living space 17, a lock 18 and a workshop 19. Preferably, the air pressure that prevails in all of said spaces corresponds to the water pressure outside said spaces. Moreover, said spaces are heated to a temperature which makes it possible for persons to stay therein for prolonged periods of time. A persons can make his way to space 5 and/or to the water outside the cover via lock space 18 and lock space 12.

On the upper side, said cover is provided with a floating body 20, which consists of compartments 21 which may be selectively filled with water or with air. This makes it possible to change the weight of the cover, thus enabling the cover to move up or down in the water.

Figure 3:
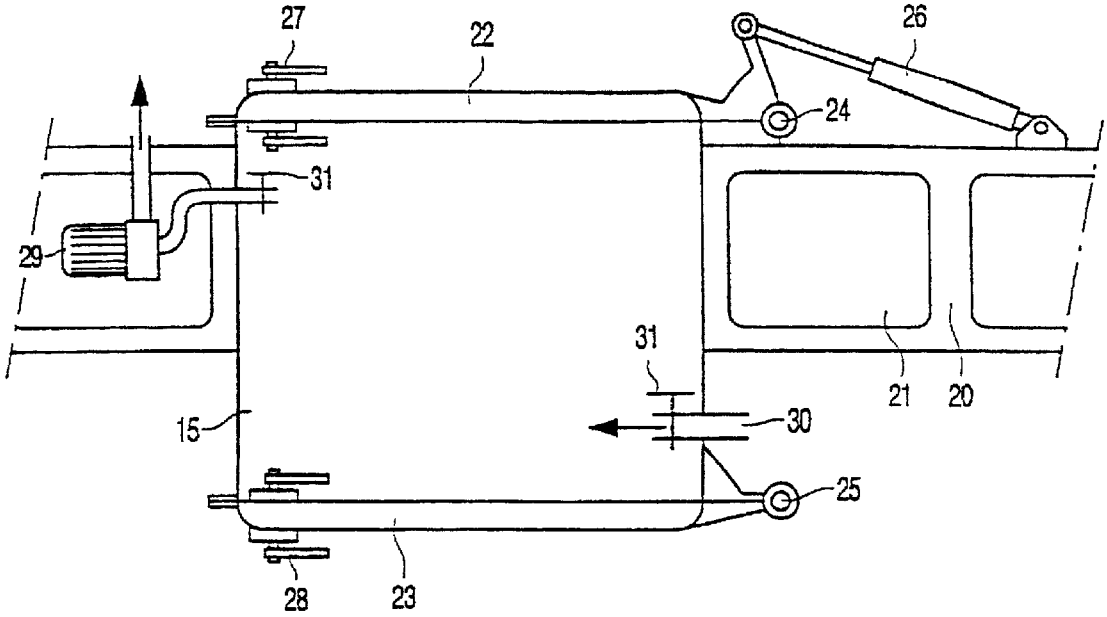
FIG. 3 is an entry lock.

FIG. 3 is a more detailed view of lock 15 (FIG. 2). Lock 15 is provided with an upper cover 22, which pivots about pivot pin 24, and with a lower cover 23, which pivots about pin 25. Upper cover 22 can be opened by means of a hydraulic cylinder 26 and it can be locked by means of a latch 27, which can be operated both inside and outside the lock space. Lower cover 23 is operated by a hydraulic cylinder (not shown), and it is likewise provided with a latch 28, which can be operated both inside and outside the lock. Operating means for operating the hydraulic cylinders to open the covers 22, 23 are furthermore present both inside the lock spaces and outside the lock spaces.

Water is sucked from the lock space by means of pump 29, and clean water can flow to said lock space via opening 30. The supplying and draining of water can be controlled by means of valves 31.

Figure 4:
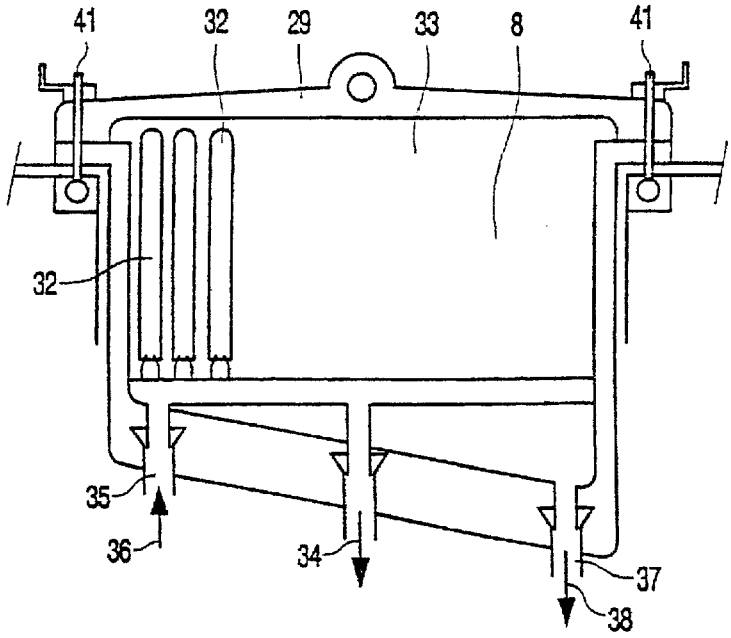
FIG. 4 is a filter device.

FIG. 4 shows a filter device 8, by means of which water which is being drawn into space 5 from the surrounding space is filtered. Said filter device is provided with a number of filter elements 32, which are disposed in a space 33 which is in communication with the space surrounding cover 1. When the pressure prevailing in space 5 is lower than the pressure in the surrounding space, water which is present in space 33 will be sucked into filter elements 32 and subsequently be carried to space 5 (arrow 34). In order to keep filter elements 32 clean, a pressure impulse is given from time to time by supplying air via conduit 35 (arrow 36), which air effects a flow through the filter in opposite direction, which has a cleaning effect on filter elements 32. The solid particles which are retained by the filter elements 32 will sink and can be drained off via conduit 37 (arrow 38).

Cover 39 of the filter device is provided with openings through which the water can pass, and it is secured by means of fasteners 41. Cover 39 can be removed in order to exchange filter element 32.

Figure 5:
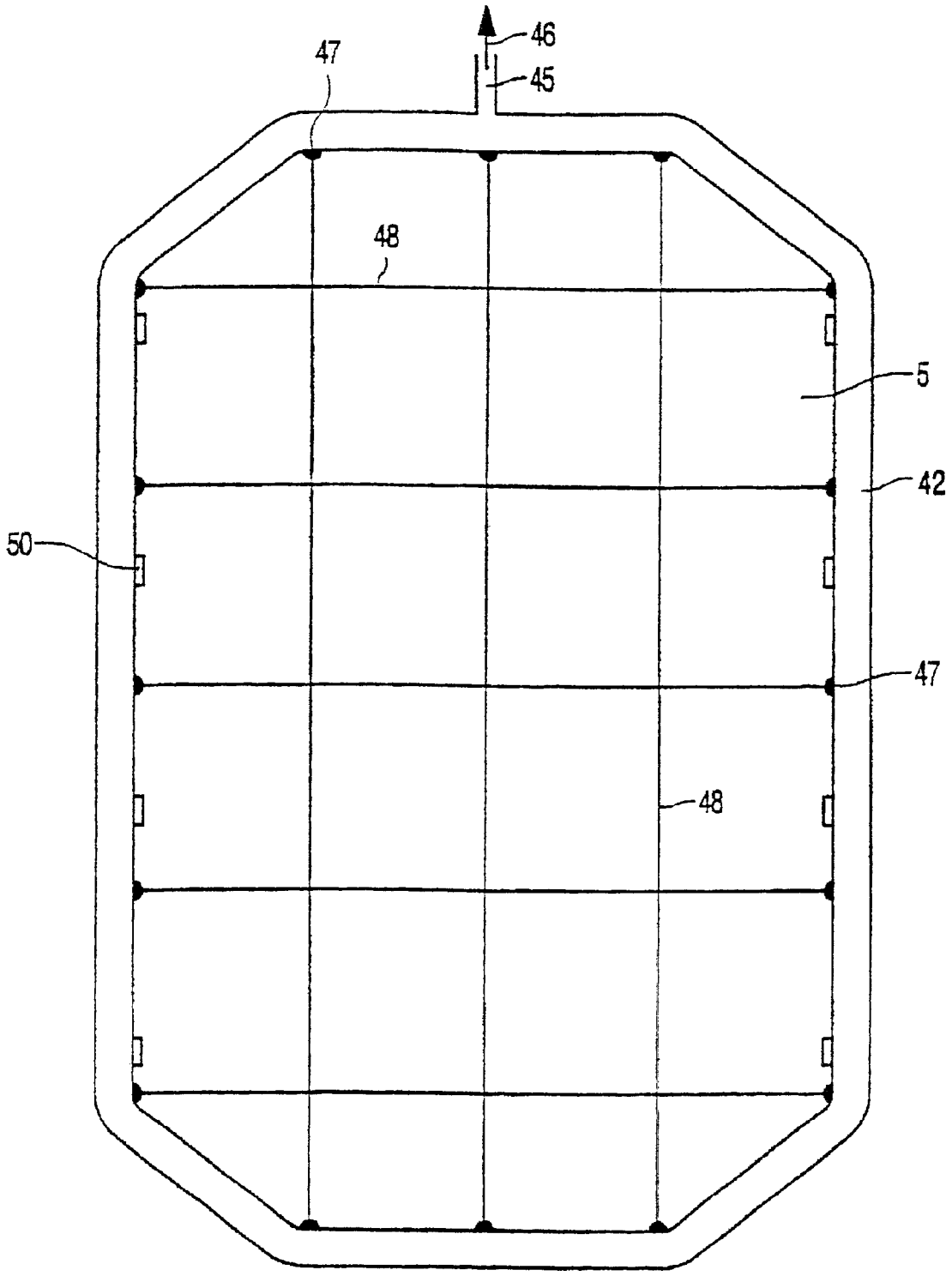
FIG. 5 is a ring line.

FIG. 5 is a plan view of a ring line 42, which is provided near the circumferential edge within the cover. Said ring line 42 has a diameter of 150–200 mm, for example, and it is provided with a large number of small holes for passing, water exiting space 5 and being drained off via ring line 42 to outlet 45 (arrow 46). Said holes for draining water (not shown) have a diameter of 6 mm, for example.

Ring line 42 is provided with a number of attachment points 47, to which wires 48, which are preferably made of steel, can be attached. Wires 48 form a grid, which can be formed so as to facilitate the measuring of a shipwreck for example.

Ring line 42 is furthermore provided with a number of closable openings 50, to which flexible hoses can be connected, which hoses can be used for draining off polluted water at random places within space 5.

Furthermore, there may be provided a similar ring line comprising connections to which flexible hoses can be connected for sucking off sand and the like at random places within space 5.

Figure 6:
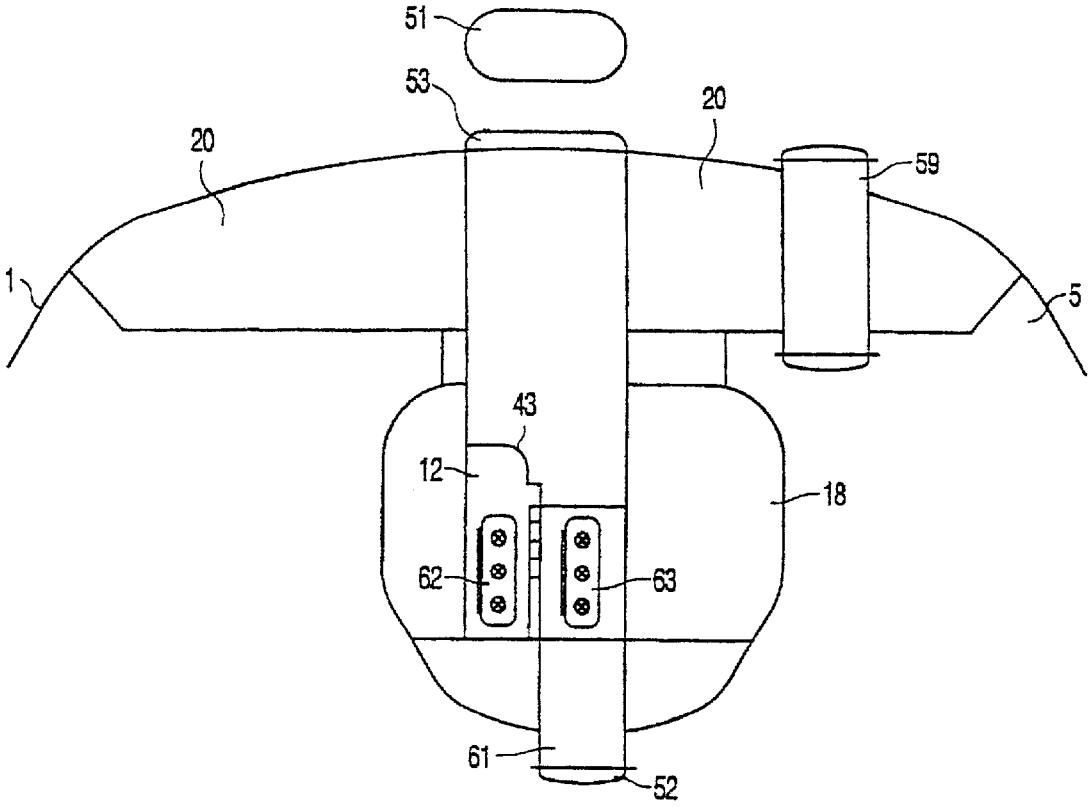
FIG. 6 is a cross-sectional view of the cover.

FIG. 6 shows a sectional view of a part of the cover at the location of lock 12, lock 61 and lock 59, which sectional view extends perpendicularly to the sectional view of FIG. 2. The shape of entrance 53 to lock 12, seen in plan view, is indicated at 51. Numeral 43 indicates the entrance door to lock 12, which lock 12 is connected to lock space 18 via door 62. A lock 61 connects lock space 18 to space 5 within cover 1, which lock 61 comprises a hatch 52 on its lower side and a door 63 which provides the connection to lock space 18.

Persons can move from space 6 to lock 61 via cover 52, and from outside the cover to lock 12 via cover 43. Naturally, persons can leave lock space 18 to space 5 or to the water outside cover 1 in a similar manner.

FIG. 6 furthermore shows another lock 59, through which persons can go from space 5 to the space surrounding cover 5, and vice versa. For safety reasons it is desirable that enough locks which can be used independently of each other be present.

Figure 7:
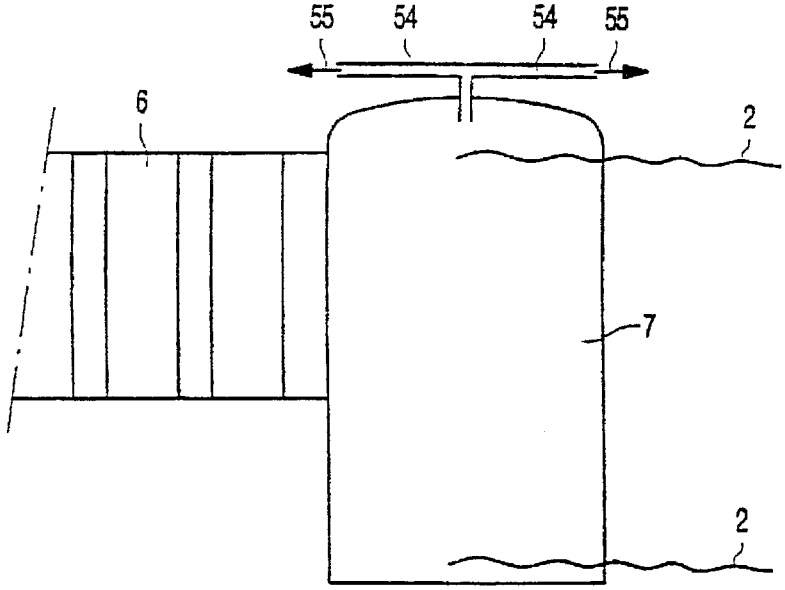
FIG. 7 shows a suction anchor.

FIG. 7 schematically shows the operation of a suction anchor 7, which can sink into bottom 2, as is shown in FIG. 7 by drawing bottom 2 twice. Suction anchor 7 sinks into the bottom in that water can be removed from the interior of the suction anchor by means of conduits 54 (arrows 55). Attached to said suction anchor is wall 6, which can be inserted into the bottom, at least partially so, by means of suction anchor 7.

Cover 1 can be moved by pulling it through the water in floating position. When cover 1 is to be moved through shallow water, floating bodies 13 can be filled with air, and additional floating bodies can be attached to the edge of the cover, if necessary.

Figure 9:
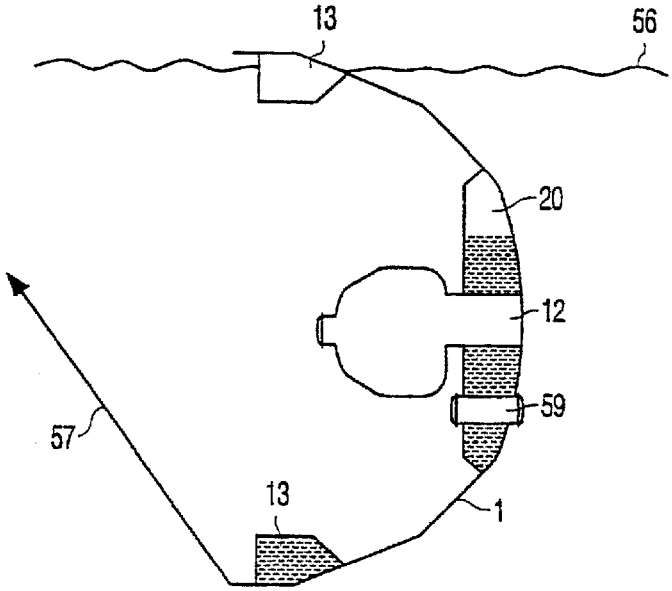
Figure 10:
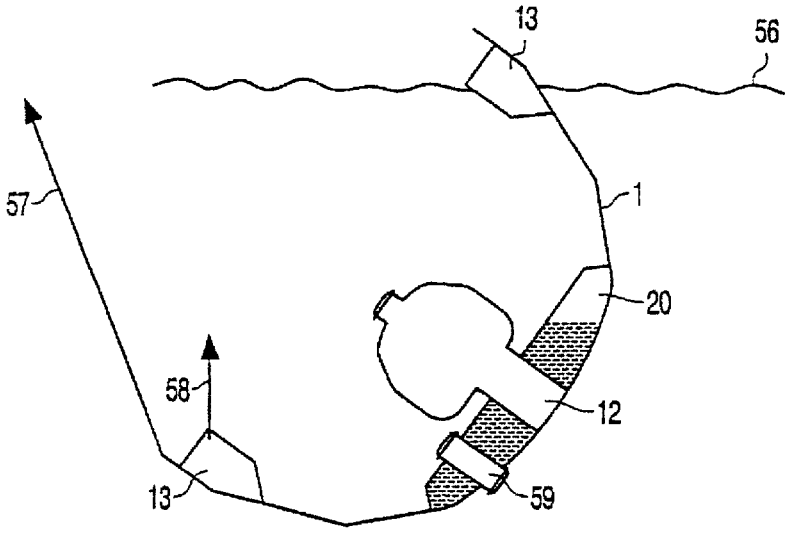

When cover 1 is to be moved a large distance, it may be desirable to give the cover a more stable position, to which end the cover may be turned upside down. Said turning upside down is shown in FIGS. 8–10.

Figure 8:
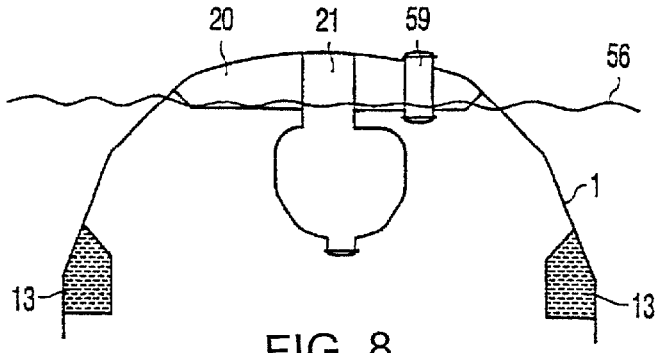
FIGS. 8–10 show the cover being turned upside-down.

FIG. 8 shows the situation wherein the compartments of floating bodies 20 are filled with air, causing cover 1 to float near the water surface 56. Floating body 13 is then filled with air on one side (FIG. 9), as a result of which cover 1 will tilt. Cover 1 can be kept in this position by means of a cable 57 when the other side of floating body 13 is filled with air (FIG. 10) as well. In the meantime, floating body 20 can be filled with water again, at least partially so, and that in such a manner that cover 1 starts to tilt (arrow 58), as a result of which cover 1 is positioned upside down in the water. When subsequently the water present within the cover is pump out, a situation is provided wherein the cover lies in the. water just as stable as a boat.

In, order to have the cover abut the bottom properly rather than be inserted therein, the edge may be provided with a flexible, tubular body, for example having a diameter of 1–3 meters, which body can be filled with sand and gravel so as to abut the bottom. Preferably, such a tubular body is subdivided into compartments.

The above-described embodiment is merely given by way of example, many variations are possible.

What is claimed is:

1. A method for carrying out work on an object which is present under water, in particular a shipwreck, wherein persons make their way to said object under water and carry out said work in artificial light, characterized in that cover is provided over the object, which cover abuts the bottom on which or in which the object is present in surrounding relationship with respect to said object, which cover encloses a space in which persons can work and within which artificial lighting is provided, which cover comprises an entrance for admitting persons to said space, and characterized in that a downwardly extending wall is pressed into the bottom at the circumferential edge of said cover.

2. A method according to claim 1, characterized in that clean water is supplied to said space, preferably near the highest point of said space.

3. A method according to claim 2, characterized in that the water being supplied is filtrated.

4. A method according to claim 1, characterized in that water is supplied to said space by utilizing the flow of the water surrounding the cover.

5. A method according to claim 1, characterized in that water is drained from said space.

6. A method according to claim 5, characterized in that water is drained from said space near the circumferential edge at a height of less than half, preferably less than one-quarter, more preferably less than one-eighth, of the height of said space.

7. A method according to claim 5, characterized in that substance is sucked from said space via a flexible conduit, which is connected to a fixedly disposed pump.

8. A method according to claim 7, characterized in that a number of connecting points are present on the inside of the cover for connecting the flexible conduit thereto, in which connecting points said flexible conduit can be connected to a fixedly disposed drainage system.

9. A method according to claim 1, characterized in that a wire is stretched at least between two points near the circumferential edge of the cover so as to be able to determine a position.

10. A method according to claim 1, characterized in that said cover is pressed against the bottom by means of suction anchors.

11. A method according to claim 1, characterized in that the cover is pressed against the bottom by reducing the pressure under said cover in comparison with the pressure outside the cover.

12. A method according to claim 1, characterized in that the pressure difference between the space under the cover and the surrounding space is maintained at a level of less than one per cent.

13. A method according to claim 1, characterized in that the pressure under the cover is essentially maintained at a level higher than that outside the cover.

14. A method according to claim 1, characterized in that persons carrying out work under the cover can go to a living space from time to time, which living space is at least partially filled with air, with the pressure of said air being substantially the same as the hydrostatic pressure prevailing under the cover, the temperature in said living space preferably being room temperature.

15. A method according to claim 1, characterized in that the cover is moved in floating position, wherein floating bodies filled with air are present near the circumferential edge.

16. A method according to claim 1, characterized in that air is compressed or electricity is generated in an engine room which is present in or near said cover.

17. A method according to claim 1, characterized in that a module which floats in the water substantially above said cover, in which module air compressors or electricity generators are present, which are connected to said space by means of, respectively, hoses and conducting wires.

18. A method according to claim 1, characterized in that lamps are mounted on the inside of the cover at a height of less than three-quarters, preferably less than half, of the height of said space.

19. A method according to claim 1, characterized in that said cover is moved while floating on the water, wherein said cover floats on the water in an upside-down position.

20. A device for carrying out work on an object which is present under water, in particular a shipwreck, wherein persons make their way to said object under water and carry out said work in artificial light, characterized by a cover to be provided over the object, which cover is capable of essentially abutting the bottom on which or in which the object is present in surrounding relationship with respect to said object, which cover encloses a space in which persons can work and within which artificial lighting is provided, which cover comprises an entrance for admitting persons to said space, and characterized in that said cover is provided near its circumferential edge with a downwardly extending wall, which can be pressed into the bottom.

21. A device according to claim 20, characterized by means for supplying clean water to said space, preferably near the highest point of said space.

22. A device according to claim 21, characterized in that a water inlet is present in one side wall and that a water inlet is present in a side wall on the other side of the cover.

23. A device according to claim 20, characterized in that filters are present for filtering the water being supplied to said space.

24. A device according to claim 20, characterized by means for draining water from said space.

25. A device according to claim 24, characterized in that drain openings are present in said space under said cover water, near the circumferential edge, at a height of less than half, preferably less than one-quarter, more preferably less than one-eighth, of the height of said space.

26. A device according to claim 24, characterized in that a flexible conduit, which is connected to a fixedly disposed pump, is provided for sucking substance from said space.

27. A device according to claim 26, characterized in that a number of connecting points are present on the inside of the cover for connecting the flexible conduit thereto, in which connecting points said flexible conduit can be connected to a fixedly disposed drainage system.

28. A device according to any claim 20, characterized in that said cover is provided near its circumferential edge with attachment points, to which wires can be attached, which wires can form a grid.

29. A device according to claim 20, characterized by suction anchors for pressing said cover against the bottom.

30. A device according to claim 20, characterized by means for reducing the pressure under said cover so as to press the cover against the bottom, or by means for increasing said pressure so as to exert an upward force on said cover.

31. A device according to claim 20, characterized by means for limiting the pressure difference between the space under the cover and the surrounding space.

32. A device according to claim 20, characterized by a living space present under or near said cover, which space is capable of accommodating persons, and by means for supplying air to said living space or by means for heating said living space.

33. A device according to claim 20, characterized by floating bodies positioned near the circumferential edge, which floating bodies can be filled with air.

34. A device according to claim 20, characterized in that an engine room is provided in or near said cover, in which air can be compressed or electricity can be generated.

35. A device according to claim 20, characterized, by a module which can float in the water above said cover, in which module air compressors or electricity generators are present, which can be connected to said space by means of, respectively, hoses and conducting wires.

36. A device according to claim 20, characterized by compartments present near the centrally positioned upper part of said cover, into which air can be introduced so as to cause the cover to rise in the water.

37. A device according to claim 20, characterized in that lamps are mounted on the inside of the cover at a height of less than three-quarters, preferably less than half, of the height of said space.

38. A device according to claim 20, characterized in that the outside of the cover, seen in sectional view of the cover, is essentially semi-circular, ellipsoid or oval.

39. A device according to claim 20, characterized in that the inside of the cover is at least locally provided with means which reflect light.

40. A device according to claim 39, characterized in that the inside of the cover, at least part thereof, has a light colour.

* * * * *